US005571383A

United States Patent [19]

Fredriksson et al.

[11] Patent Number: 5,571,383

[45] Date of Patent: Nov. 5, 1996

[54] METHOD AND DEVICE FOR TRANSVERSE DISTRIBUTION OF A FLOWING MEDIUM

[75] Inventors: Borje Fredriksson, Sundsbruk; Lennart Svensson, Sundsvall, both of Sweden

[73] Assignee: Sunds Defibrator Industries, Sweden

[21] Appl. No.: 424,380

[22] Filed: May 4, 1995

[30] Foreign Application Priority Data

Nov. 4, 1992 [SE] Sweden ..... 92032572

[51] Int. Cl.[6] ..... D21F 1/02; F15D 1/12

[52] U.S. Cl. ..... 162/213; 162/315; 162/317; 162/324; 162/325; 162/336; 162/339; 118/232

[58] Field of Search ..... 162/213, 212, 162/315, 318, 321, 324, 325, 327, 317, 336, 328, 339, 344; 118/413, 410, 232

[56] References Cited

U.S. PATENT DOCUMENTS

| | | | |
|---|---|---|---|
| 1,662,226 | 3/1928 | Witham, Jr. | 162/322 |
| 1,866,607 | 7/1932 | Wood | 162/343 |
| 2,127,698 | 8/1938 | Niks | 162/317 |
| 2,186,761 | 1/1940 | Malkin | 162/322 |
| 2,329,799 | 9/1943 | Thorsen | 162/322 |
| 2,351,905 | 6/1944 | Basler | 162/407 |
| 2,658,430 | 11/1953 | Stevens | 162/339 |
| 2,677,316 | 5/1954 | Heys | 162/337 |
| 4,050,499 | 9/1977 | Luey et al. | 162/317 |

FOREIGN PATENT DOCUMENTS 2232074 10/1977 Germany .

2620033 7/1982 Germany .

*Primary Examiner*—Donald E. Czaja
*Assistant Examiner*—Jose A. Fortuna
*Attorney, Agent, or Firm*—Lerner, David, Littenberg, Krumholz & Mentlik

[57] ABSTRACT

Methods and apparatus are disclosed for uniformly distributing a flowing medium flowing in a first direction in a conduit onto a surface so as to form a uniformly distributed medium thereon having a width greater than that of the conduit, the method including deflecting the flow of the flowing medium and simultaneously spreading the flowing medium from the width of the conduit to the greater width in a direction transverse to the first direction, and again deflecting the flowing medium in a passage having a generally curvilinear shape transverse to the surface in order to provide a substantially uniformly distributed and parallel flow of the flowing medium onto the surface. The disclosed apparatus includes a distribution housing including an inlet for the conduit and an outlet for the surface so as to form a uniformly distributed medium thereon, the distribution housing including a first distribution chamber substantially transverse to the conduit and diverging from the inlet to a substantially curved surface, a second distribution chamber extending from the substantially curved surface in a direction opposite that of the first distribution chamber, and a passage associated with the substantially curved surface for deflecting the flowing medium between the first distribution chamber and the second distribution chamber so as to provide a substantially uniformly distributed parallel flow of the flowing medium onto the surface.

26 Claims, 2 Drawing Sheets

METHOD AND DEVICE FOR TRANSVERSE DISTRIBUTION OF A FLOWING MEDIUM

FIELD OF THE INVENTION

The present invention relates to a method and apparatus for spreading a flowing medium uniformly and distributing it in a transverse direction. More particularly, the present invention relates to such methods and apparatus employing a medium which consists of, for example, liquids, gases, foam or mixtures of various types of materials.

BACKGROUND OF THE INVENTION

The present invention can be applied, for example, to cellulose and the demand of the papermaking industry to form webs of fiber suspensions, which often exceed 10 meters in width, and which are required to meet very high requirements on uniformity, both in the transverse and longitudinal directions. Indeed, the uniformity of these webs is often of decisive importance in terms of the efficiency and economy of the process.

During the liquid treatment of fiber suspensions, for example, such as during their washing or bleaching and dewatering, it is essential that the pulp is supplied to and transversely distributed on a running liquid-permeable support as uniformly as possible, both in the transverse and longitudinal directions. It is also essential that the processing liquid be distributed uniformly across the pulp web. Such uniform distribution prevents channelization, and thus uneven liquid treatment and dewatering.

In order to make optimum usage of the apparatus being employed, a suspension of cellulose fibers to be dewatered, such as in connection with a liquid treatment, must be supplied at the highest possible concentration and formed on the support, through which liquid is sucked out. This support can be a perforated roll or a planar wire. The desired highest possible concentration is controlled by the capacity of the equipment to transversely distribute the medium with sufficient uniformity and to form a homogeneous web in order to satisfy the demand of the process in question. The difficulty of distributing the fiber suspension uniformly across the entire width increases rapidly with increasing pulp concentration, due to the increasing shearing strength of the fiber network.

A non-uniform distribution of the fiber suspension not only results in non-uniform dewatering, and thereby yields a poor efficiency of the liquid treatment, but it can also cause damage to the fibers in a press, and thereby deteriorate the pulp quality. In the nip between the rolls, for example in a press, fiber flocks and thick portions of the pulp web can be subjected to such high pressure forces that the fibers are damaged in these load-carrying portions.

It is therefore apparent that a uniform distribution of the fiber suspension as well as of the processing liquid is of utmost importance for both the quality of the final product and of the economy of the process. Many different distribution devices have been developed in attempts to solve the aforesaid problems, but in many cases the problems remain, especially during sheet forming at high fiber concentrations.

SUMMARY OF THE INVENTION

In accordance with the present invention, these and other objects have now been accomplished by the invention of a method for uniformly distributing a flowing medium flowing in a first direction in a conduit having a first width onto a surface so as to form a uniformly distributed medium having a second width, in which the second width is greater than the first width, the method comprising deflecting the flowing medium and simultaneously spreading the flowing medium from the first width to the second width in a direction transverse to the first direction, and again deflecting the flowing medium in a passage having a generally curvilinear shape transverse to the surface so as to provide a substantially uniformly distributed and parallel flow of the flowing medium onto the surface at the second width. Preferably, the flowing medium is a medium such as a liquid, gas, foam, or mixture thereof.

In accordance with a preferred embodiment of the method of the present invention, the method includes deflecting the flowing medium in a passage having a parabolic shape. In a preferred embodiment, the method includes supplying the flowing medium in the conduit at the focus of the parabolic shape. In accordance with another embodiment, however, the method includes deflecting the flowing medium in a passage having an arcuate shape, and preferably supplying the flowing medium in the conduit at the center of the cord of the arcuate shape. In a preferred embodiment, the distance from the conduit to the passage is about one-fourth of the length of the cord.

In accordance with another embodiment of the method of the present invention, deflecting of the flowing medium in the passage is carried out so that each corresponding equal sector of the flowing medium spreading in the transverse direction feeds corresponding equal portions of the second width.

In accordance with another embodiment of the present invention, the method includes spreading the flowing medium onto the surface in a direction forming an angle with that surface. Preferably, the surface comprises a moving support surface. In another embodiment, the method includes spreading the flowing medium onto the surface in a direction parallel to that surface.

In accordance with another aspect of the present invention, apparatus have also been developed for uniformly distributing a flowing medium flowing in a first direction in a conduit having a first width onto a surface so as to form a uniformly distributed medium having a second width, the second width being greater than the first width, the apparatus including a distribution housing having an inlet for the conduit and an outlet for the surface, the distribution housing including a first distribution chamber substantially transverse to the conduit and diverging from the inlet to a substantially curvilinear surface, a second distribution chamber extending from the substantially curvilinear surface in a direction opposite to the first distribution chamber, and passage means associated with the substantially curvilinear surface for deflecting the flowing medium between the first distribution chamber and the second distribution chamber so as to provide a substantially uniformly distributed parallel flow of the flowing medium in the surface at the second width. Preferably, the flowing medium is a liquid, gas, foam, or mixture thereof.

In accordance with one embodiment of the apparatus of the present invention, the apparatus includes inner wall means separating the first distribution chamber from the second distribution chamber. In a preferred embodiment, the inner wall means includes a first end, and the passage means is defined by the first end of the inner wall means and the substantially curvilinear surface.

In accordance with another embodiment of the apparatus of the present invention, the passage means has a width corresponding to the second width and a height between about ⅛ and ½ of the second width. Preferably, the passage means has a height approximately ¼ of the second width.

In accordance with another embodiment of the apparatus of the present invention, the inlet is located approximately at the center of the first distribution chamber. In another embodiment, the substantially curvilinear surface has a parabolic shape, and the conduit is located at the focus of the parabolic shape. In another embodiment, the substantially curvilinear surface has an arcuate shape, and the conduit is located a distance from the passage means of about ¼ of the width of the passage.

In accordance with another embodiment of the apparatus of the present invention, the substantially curvilinear surface has a curve defined by the formula $$y = \frac{X}{\tan\left(\frac{\pi \cdot X}{b}\right)}$$

wherein the inlet is located a distance from the passage means of about b/π of the width of the passage means.

In accordance with another embodiment of the apparatus of the present invention, the conduit has a semicircular cross-section, including a flat surface located distal from the passage means. Preferably, the surface is a movable support surface, and the outlet is directed at an angle between about 0° and 90° to said movable support surface. In accordance with the present invention, improved spreading and transverse distribution of a supplied flowing medium can now be achieved. Thus, according to this invention, the flow of the medium is deflected in a transversely curved passage to an outgoing, substantially uniformly distributed and parallel flow. The passage can have a continuous or polygonic curvature.

BRIEF DESCRIPTION OF THE DRAWINGS

The present invention may be more fully appreciated with reference to the following detailed description, by referring to the drawings in which.

DETAILED DESCRIPTION

Figure 1:
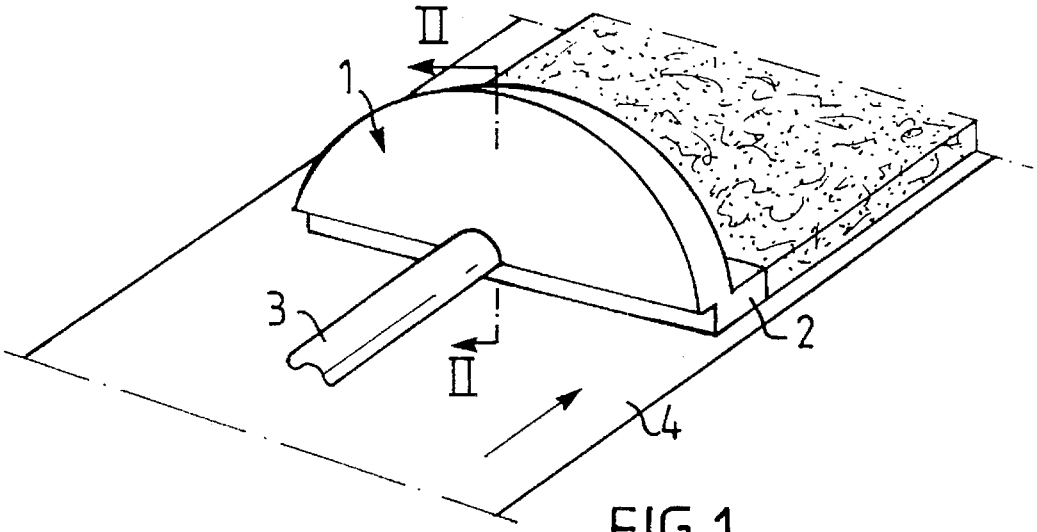
FIG. 1 shows a front, perspective view of a transverse distribution device according to the present invention.
Figure 2:
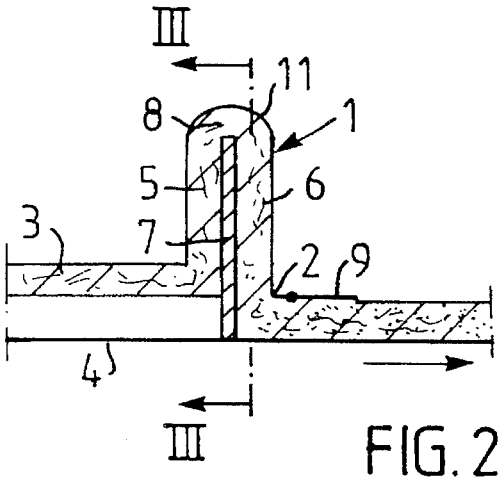
FIG. 2 is a side, cross-sectional view of the device shown in FIG. 1 taken along lines II—II thereof.
Figure 3:
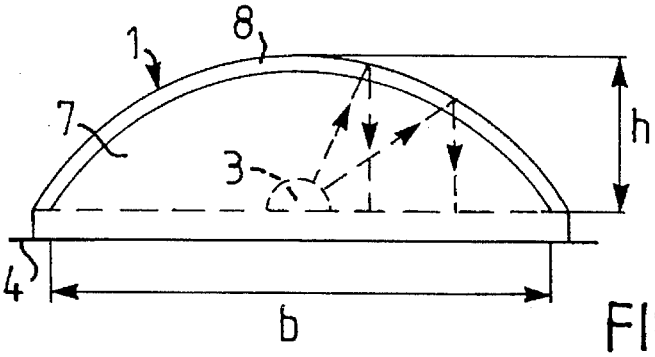
FIG. 3 is a front, partially perspective view of the device shown in FIG. 2 taken along lines III—III thereof.

Referring to the Figures, in which like reference numerals refer to like portions thereof, the embodiment of the invention shown in FIG. 1 shows a device for transverse distribution and forming of a pulp web of a fibrous material. The device comprises a distribution housing 1 with a wide, substantially rectangular outlet opening 2 and a feed line 3 for the fiber suspension. The outlet opening can be directed angularly to or in parallel with a running liquid-permeable support 4, which can be, for example, a plane wire or a perforated roll.

The distribution housing 1 is formed with a distribution chamber 5, which is arranged substantially across the feed line 3, and which extends from the connection of feed line 3 diverging in a direction outwardly to a transversely curved passage with a deflection surface 11. The distribution housing 1 further comprises an outlet chamber 6, which extends in the opposite direction from the deflection in the passage 8 to the outlet 2. The two chambers 5,6 are separated by an inner wall 7 in the housing 1 and communicate with each other through passage 8. This passage 8 is curved in the transverse direction and is thus defined by the free end of the inner wall 7 and the deflection surface 11, which can have a shape which is curved continuously or polygonically in the transverse direction. Polygonic shape implies that the passage 8 is defined by a plurality of substantially plane or straight portions, which together define the curvilinear shape of the passage. The passage can also be assembled from a variety of portions of different curvature. The transversely curved deflection surface 11 is preferably curved in the longitudinal direction with a particular radius. Alternatively, it can be planar, or shaped in some other way in order to achieve special effects affecting the flow characteristics, for example to provide a flow which is more or less turbulent. The inner wall 7 can be formed so that the end defining the passage 8 has a shorter or longer extension in the direction of flow of the medium. This end can have a rounded or abrupt configuration. The dimensioning of the passage 8, i.e. the configuration of the deflection surface 11 and the end of the wall 7, must be adapted to the requirements of the process and of the final product.

The passage 8 which is curved in transverse direction must be formed so that the flowing medium from the distribution chamber 5 is deflected in the passage 8 to the outlet chamber 6 to provide a substantially uniformly distributed and parallel flow. This can be achieved by forming the curved passage 8 so that its height h is between about ⅛ and ½, and preferably about ¼ of its width b, and that the outlet opening 2 has the same width as the passage 8. The inlet of the feed line 3 to the distribution chamber 5 shall be located approximately at the center of the width of the distribution chamber, and at a distance from the passage 8 of between about ⅛ and ½, and preferably about ¼ to ⅓, of the width b of the passage 8.

The passage 8 is preferably shaped substantially as a parabola, and the feed line 3 is located approximately at the focus of the parabola. Alternatively, the passage 8 can substantially have the shape of an arc. The feed line 3 in that case is placed approximately at the center of the chord of the arc at a distance to the passage 8 of about ¼ of the chord length, i.e. the width b of the passage.

During, for example, high concentration forming of a pulp web consisting of a long-fiber cellulose pulp, the fiber suspension can be supplied through the feed line 3 at a fiber concentration of up to about 12%, and preferably between about 5–10%. The flow rate can then be about 5–50 m/s, and preferably between about 8–20 m/s. The fiber suspension entering the distribution chamber 5 meets the inner wall 7 of the housing 1 and is deflected thereby. The high rate of the fiber suspension during impact on the partition wall 7 thus creates a zone of high energy intensity whereby the fiber network is disintegrated and the pulp is fluidized. The suspension is spread from the inlet at a decreasing rate outward in the diverging distribution chamber 5 to the passage 8 where it is again deflected to the outlet chamber 6, through which the suspension flows substantially in parallel and at a constant rate to the outlet opening 2 and support 4.

Particularly in the case where the passage 8 is shaped as a parabola, and the pulp is supplied to the focus of the parabola and is spread outward from there, every portion of the flow will be deflected in the passage 8 to a spread parallel flow substantially perpendicular to the outlet 2. Every portion of the flow will thus have a substantially equally long path from the connection of the feed line 3 through the passage 8 to the outlet 2, irrespective of the direction in the distribution chamber 5. This implies that the pressure drop from the inlet to the outlet is constant across the entire width of the outlet 2, and thereby ensures a uniform distribution of the medium across the entire width. In practice, substantially the same effect can be achieved even when the passage 8 has a curvature other than that described above.

It may also be suitable to form the curvature of the passage 8 so that the medium flow supplied and spread in the distribution chamber over 180° is so deflected in the passage 8, that each sector of equal size of the spread flow feeds corresponding equally wide portions of the outlet 2. Such a curve shape can be described generally by the formula $$y = \frac{X}{\tan\left(\frac{\pi \cdot X}{b}\right)}$$

The maximum height h is then b/π. The passage 8 can then have a shape which is curved continually or polygonically, or which is assembled with a variety of differently curved portions.

The outlet opening 2 can possibly be provided with a movable or flexible lip 9 extending a distance from the distribution house 1 in order to additionally stabilize the pulp web formed.

The feed line 3 can be given a semi-circular cross-section in which the flat side of the line is remote from the passage 8.

Figure 4:
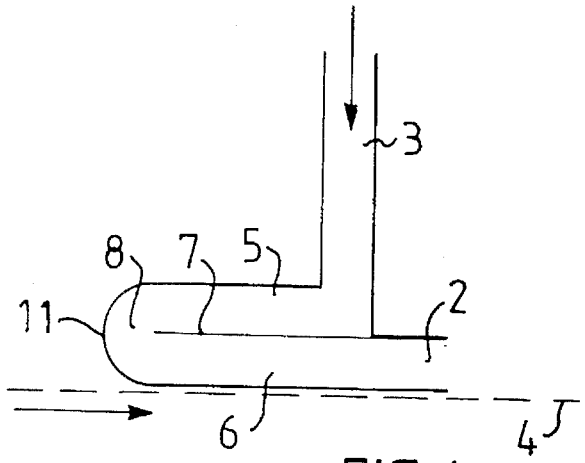
FIG. 4 is a side, partially perspective view of another embodiment of the transverse distribution device according to the present invention.

In FIG. 4 an embodiment of the present invention is shown where the fiber suspension is applied in parallel with the movement of the liquid-permeable support 4. Compared with the embodiment shown in FIG. 1, FIG. 4 differs even in that the opposite side of the pulp web is laid against the support, i.e. that side which faces the deflection surface 11 in the passage 8.

Figure 5:
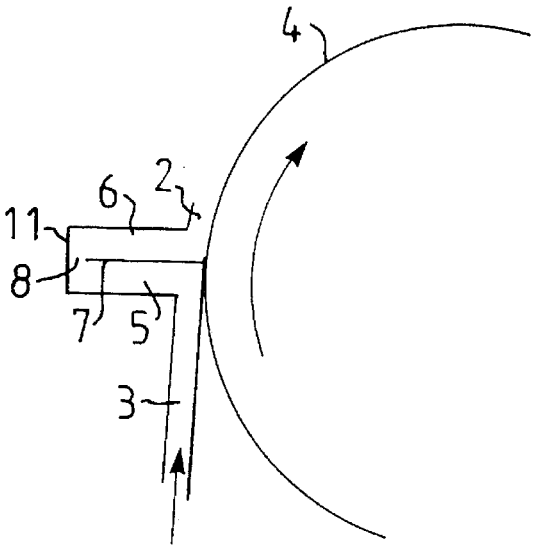
FIG. 5 is a side, partially perspective view of another transverse distribution device according to the present invention.

In FIG. 5 an embodiment is shown where the fiber suspension is supplied from below and applied onto a curved surface, for example a roll. The passage 8 in this case is defined by a planar deflection surface 11.

Figure 6:
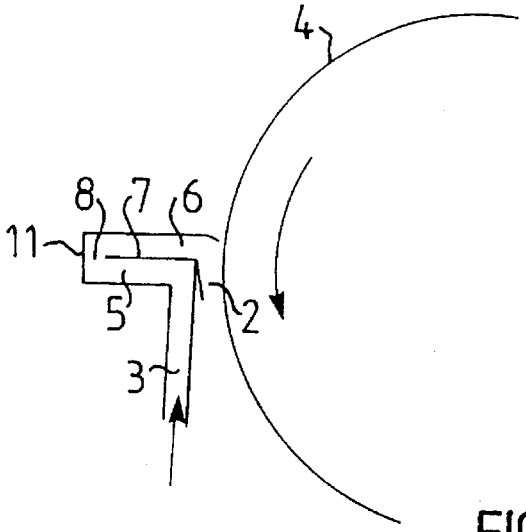
FIG. 6 is a side, partially perspective view of another transverse distribution device according to the present invention.

The embodiment according to FIG. 6 corresponds to that in FIG. 5, except that the roll here rotates in the opposite direction, and the outlet 2 is directed downward.

The invention has been illustrated as a device for distributing a pulp suspension, but it is obvious that the invention can also be applied to other flowing media where a uniform transverse distribution is to be obtained. One example thereof is the supply of processing liquid across a material web.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. A method for uniformly distributing a flowing medium flowing in a first direction in a conduit having a first width onto a surface so as to form a uniformly distributed medium having a second width, said second width being greater than said first width, said method comprising deflecting said flowing medium and simultaneously spreading said flowing medium from said first width to said second width in a plane transverse to said first direction, and again deflecting said flowing medium in a passage having a curvilinear shape in said plane, so as to provide a substantially uniformly distributed and parallel flow of said flowing medium onto said surface at said second width.

2. The method of claim 1 wherein said flowing medium comprises a medium selected from the group consisting of liquids, gases, foams, and mixtures thereof.

3. The method of claim 1 wherein said deflecting of said flowing medium in said passage is carried out so that each corresponding equal sector of said flowing medium spreading in said transverse direction feeds corresponding equal portions of said second width.

4. The method of claim 1 comprising deflecting said flowing medium in said passage having a parabolic shape.

5. The method of claim 4 including supplying said flowing medium in said conduit at the focus of said parabolic shape.

6. The method of claim 1 wherein said uniformly distributed and parallel flow forms an angle with said surface.

7. The method of claim 6 wherein said surface comprises a moving support surface.

8. The method of claim 1 wherein said uniformly distributed and parallel flow is parallel to said surface.

9. The method of claim 8 wherein said surface comprises a moving support surface.

10. The method of claim 1 including deflecting said flowing medium in said passage having an arcuate shape.

11. The method of claim 10 including supplying said flowing medium in said conduit at the center of the chord of said arcuate shape.

12. The method of claim 11 wherein the distance from said conduit to said passage is about ¼ of the length of said chord.

13. Apparatus for uniformly distributing a flowing medium flowing in a first direction in a conduit having a first width onto a first surface so as to form a uniformly distributed medium having a second width, said second width being greater than said first width, said apparatus comprising a distribution housing including an inlet for said conduit and an outlet for said surface, said distribution housing including a first distribution chamber in a plane transverse to said conduit and diverging from said inlet to a surface having a curvilinear shape in said plane of said first distribution chamber, a second distribution chamber extending from said curvilinear surface in a direction opposite to said first distribution chamber, and passage means associated with said curvilinear surface for deflecting said flowing medium between said first distribution chamber and said second distribution chamber so as to provide a substantially uniformly distributed parallel flow of said flowing medium on said first surface at said second width.

14. The apparatus of claim 13 wherein said flowing medium comprises a medium selected from the group consisting of liquid, gas, foam, and mixtures thereof.

15. The apparatus of claim 13 wherein said curvilinear surface has a parabolic shape, and wherein said conduit is located at the focus of said parabolic shape.

16. The apparatus of claim 13 wherein said curvilinear surface has an arcuate shape and wherein said inlet is separated from said passage means by a distance corresponding to about ¼ of the width of said passage means.

17. The apparatus of claim 13 wherein said curvilinear surface has a curve defined by the formula $$y=\left(\frac{X}{\tan\frac{\pi * X}{b}}\right)$$

and wherein b is a width of said passage means and X and y are Cartesian coordinates perpendicular and parallel, respectively, to said first surface.

18. The apparatus of claim 13 wherein said conduit has a semicircular cross-section with a flat side, with said flat side located distal from said passage means.

19. The apparatus of claim 13 wherein said first surface comprises a movable support surface.

20. The apparatus of claim 19 wherein said outlet is directed at an angle of between 0° and about 90° with respect to said movable support surface.

21. The apparatus of claim 13 including inner wall means separating said first distribution chamber from said second distribution chamber.

22. The apparatus of claim 21 wherein said inner wall means includes a first end, and said passage means is defined by said first end of said wall means and said curvilinear surface.

23. The apparatus of claim 13 wherein said passage means has a width corresponding to said second width, and a height between about ⅛ and ½ of said second width.

24. The apparatus of claim 23 wherein said passage means has a height which is about ¼ of said second width.

25. The apparatus of claim 13 wherein said inlet is located approximately at the center of said first distribution chamber.

26. The apparatus of claim 25 wherein said passage means has a width corresponding to said second width and a height of between about ⅛ and ½ of said second width.

* * * * *

UNITED STATES PATENT AND TRADEMARK OFFICE

CERTIFICATE OF CORRECTION

PATENT NO. : 5,571,383

DATED : November 5, 1996

INVENTOR(S) : Fredriksson et al.

It is certified that error appears in the above-identified patent and that said Letters Patent is hereby corrected as shown below:

On the title page after "[21] Appln. No.: 424,380" insert:

PCT/SE93/00807

1A Filing Date: October 6, 1993

Priority Date: November 4, 1992

102 Date: May 4, 1995

371: May 4, 1995

Signed and Sealed this

Twenty-eighth Day of January, 1997

*Attest:*

Bruce Lehman

BRUCE LEHMAN

*Attesting Officer* *Commissioner of Patents and Trademarks*